United States Patent [19]

Vrhel, Sr. et al.

[11] Patent Number: 5,024,142

[45] Date of Patent: Jun. 18, 1991

[54] CYCLICALLY OPERATING FLUID DRIVE MOTOR WITH MAGNETICALLY CONTROLLED DIAPHRAGM VALVES

[76] Inventors: Thomas Vrhel, Sr., 5782 Barnswell Way, San Jose, Calif. 95138; Thomas Vrhel, Jr., 918 Clinton Rd., Los Altos, Calif. 94024

[21] Appl. No.: 384,323

[22] Filed: Jul. 24, 1989

[51] Int. Cl.[5] ..... F01L 25/08

[52] U.S. Cl. ..... 91/271; 91/275; 91/323; 91/346; 91/353; 91/457; 92/136; 15/28; 15/29; 15/22.2

[58] Field of Search ..... 15/28, 29, 22 R, 22 A; 92/136; 91/275, 345-347, 352, 454, 457, 464, 269, 270, 271, 310, 314, 315, 323, 324, 350, 351, 354, 353

[56] References Cited

U.S. PATENT DOCUMENTS

| | | | |
|---|---|---|---|
| 734,276 | 7/1903 | Metcalf et al. | 91/310 X |
| 1,747,921 | 2/1930 | Abels | 91/351 X |
| 1,864,609 | 6/1932 | Musolf | 91/351 X |
| 2,239,727 | 4/1941 | Mayer | 91/314 X |
| 2,280,588 | 4/1942 | Knott et al. | 91/310 X |
| 2,366,693 | 1/1945 | Benaway | 91/457 X |
| 2,372,813 | 4/1945 | Darling | 91/275 X |
| 2,511,181 | 6/1950 | Sivacek | 91/351 X |
| 2,626,527 | 1/1953 | Meyers | 91/347 X |
| 2,627,251 | 2/1953 | Sprague et al. | 92/136 X |
| 2,671,433 | 3/1954 | Meddock | 91/457 X |
| 2,676,466 | 4/1954 | Klessig et al. | 91/314 X |
| 2,752,895 | 7/1956 | MacDuff | 91/310 X |
| 3,153,985 | 10/1964 | Riley et al. | 91/310 X |
| 3,587,396 | 6/1971 | Gadd et al. | 91/310 X |
| 4,103,381 | 8/1978 | Schulz et al. | 15/29 |
| 4,155,137 | 5/1979 | Kadlub | 15/29 X |
| 4,509,402 | 4/1985 | Salmonson | 91/275 |

FOREIGN PATENT DOCUMENTS

| | | | |
|---|---|---|---|
| 62266 | 10/1982 | European Pat. Off. | 92/136 |
| 548035 | 9/1956 | Italy | 91/347 |
| 2054798 | 2/1981 | United Kingdom | 92/136 |

*Primary Examiner*—Edward K. Look
*Assistant Examiner*—George Kapsalas
*Attorney, Agent, or Firm*—John J. Leavitt

[57] ABSTRACT

Presented is a fluid drive motor that may be attached to a conventional garden hose, for instance, to effect reciprocating motion of a drive shaft that may be connected to a utilitarian device, such as a scrub brush. The fluid drive motor is provided with a piston assembly that responds to the pressure of the fluid to translate the piston assembly from one position to another and in so doing imposes rotational reciprocation on a drive shaft that extends out of the motor block of the fluid drive motor. The reciprocating characteristics of the piston assembly are controlled by the imposition of fluid pressure, and the imposition of fluid pressure is controlled by a valve assembly cooperating with a reciprocable magnetic bar to channel fluid under pressure alternately to opposite ends of the piston assembly.

5 Claims, 6 Drawing Sheets

CYCLICALLY OPERATING FLUID DRIVE MOTOR WITH MAGNETICALLY CONTROLLED DIAPHRAGM VALVES

BACKGROUND OF THE INVENTION

1. Field of the Invention

1. This invention relates to a fluid drive motor of the type that might be used to drive a scrub brush for washing automobiles, boats, recreation vehicles or industrial appliances and fixtures, and more particularly to a fluid drive motor that incorporates a magnetic control assembly to control rotary reciprocation of the output shaft of the fluid motor so as to impart a rotary reciprocating motion to a utilization device mounted on the shaft, such as a scrub brush, or other device.

2. Description of the Prior Art.

A preliminary patentability and novelty search conducted in connection with this invention has revealed the existence of the following U.S. Pat. Nos.:

| | | |
|---|---|---|
| 2,626,527 | 2,627,251 | 2,981,240 |
| 3,013,531 | 3,192,865 | 3,771,420 |
| 3,965,801 | 4,188,857 | 4,291,613 |
| | 4,509,402 | |

Applicants are of course aware that there are many different mechanisms that utilize the flow and/or pressure of a fluid, either gaseous or liquid, to power a gear train or a shaft to drive a variety of utilization devices. Such a structure is illustrated in U.S. Pat. No. 2,626,527 which discloses a novel snap-action valve mechanism for reciprocating a piston in a fluid driven motor. While this patent is silent as to applications in which this mechanism might be used, it is apparent that such a mechanism might be used, for example, in driving a windshield wiper.

U.S. Pat. No. 2,627,251 also discloses a fluid operated motor for driving a windshield wiper, and is adapted to be operated by a difference in pressure acting upon opposite sides of a shiftable member such as a piston.

U.S. Pat. No. 2,981,240 relates to a device which utilizes the pressure of a flowing fluid to actuate a meter for measuring the amount of flow of such fluid. Such a device might be used for instance, in a gas meter to measure the cubic feet of a gas that passes through the meter, or in a water meter to measure the amount of water delivered to a residence, for example. It is noted that none of the foregoing three patents are susceptible to operation when a substantial retarding force is applied to the member that is driven by the fluid motor.

U.S. Pat. No. 3,013,531 is directed to a valve structure as might be used in an air motor of the type used in a lubricant gun for driving a lubricant pump in the gun. The principal object of this invention is the provision of a simplified valve construction which provides a positive, reliable snap action of the valve at the ends of the stroke of the piston of the air motor.

U.S. Pat. No. 3,192,865 relates to an apparatus for pumping fluids by the use of hydraulic power such as, for example, a flow of hydraulic fluid from a gear or vane-type pump.

U.S. Pat. No. 3,771,420 relates to a device for converting a stream of liquid, such as water or hydraulic fluid, into a succession of liquid pulses. The pulses are formed by opening and closing a valve placed in a fluid flow path, and magnetic forces are used to accomplish valve actuation, and employ a pressure differential across the valve to render the magnetic elements effective.

U.S. Pat. No. 3,965,801 relates to an abrading device in which the abrading element operates in a straight line and is driven by compressed air.

U.S. Pat. No. 4,188,857 also relates to a pneumatic sanding and rubbing machine as might be used in woodworking or fine furniture finishing. This device utilizes a shoe portion carrying the abrading material, reciprocating motion of the piston that drives the shoes being achieved by means of pneumatic valving employing a rotatable valving member which is driven by a rack and pinion gear assembly in response to motion of the shoe.

U.S. Pat. No. 4,291,613 relates to a safety device of the type that might be used, for instance, on a press or shear for sheet metal to disable the machine should the pneumatic control system exhibit faulty behavior.

U.S. Pat. No. 4,509,402 relates to a magnetic snap action directional control valve mechanism for use with a fluid pressure actuated reciprocating motor or pump.

SUMMARY OF THE INVENTION

As will be seen from the mechanisms illustrated in the patents discussed above, most of these devices utilize complex structures embodying complicated machine-formed components and assembly of such machine-formed parts in a critical manner. Such structural and assembly techniques increase the cost of the devices, and thereby makes them less attractive to the buying public. Accordingly, it is one of the objects of the present invention to provide a fluid operated motor that is relatively simple in its construction and which can be manufactured by plastic injection molding techniques so that close repeatability of configurations and tolerances of the parts may be achieved at relatively low cost.

Another object of the invention is to provide a fluid operated motor that may be driven by a gaseous fluid or a liquid fluid.

In many applications, it would be an advantage for a fluid driven motor to possess a captive exhaust for the pressure fluid, especially when the pressure fluid is water, so that most or all of the working fluid, when appropriate, may be recycled or put to another use. Capturing exhaust fluid prevents contamination and waste of working fluid while the device is in use. Accordingly, another object of the invention is the provision of a fluid driven motor for a scrubbing device, or other implements, which includes a captive exhaust that channels the fluid being used to drive the motor to an appropriate receptacle or other end use.

Most fluid driven motors of which the applicants are aware do not provide a provision for bleeding off a portion of the fluid utilized to drive the motor. Accordingly, another important object of the invention is the provision of a hydraulically driven motor for driving a scrubbing assembly in which a portion of the fluid used for driving the motor may be bled off and used in conjunction with the scrubbing element for cleaning purposes.

Applicants are aware that many different types of fluid driven devices, usually water-driven, have been marketed for the purpose of washing a car, for instance, or a boat, or recreational vehicle. Such devices usually utilize the kinetic energy of the fluid flowing through the device to rotate a brush, and the fluid flowing through the device is permitted to flow onto or under the brush or onto the surface being scrubbed, and no attempt is made to capture or recycle the fluid being used. Accordingly, it is another object of the invention to provide a structure that enables the brush to operate by the pressure energy of the fluid flowing therethrough as distinguished from the kinetic energy thereof, and which also provides a captive exhaust to collect the fluid rather than wasting it, with the additional capability of bleeding off a portion of the fluid.

Still another object of the invention is the provision of a scrubbing device and hydraulic motor for driving the scrubbing device which utilizes a reciprocating motion on the scrubbing device that is achieved through the shifting of magnets within the hydraulic motor to control channeling of fluid through one passage or another to effect reciprocation.

Still another object of the invention is the provision of a scrubbing device and hydraulic motor therefor which incorporates means that may be actuated for rinsing off with clean water a vehicle, for example, that has been scrubbed with a grease cutting detergent.

Still another object of the invention is the provision of a scrubbing device driven by a hydraulic motor that is so powerful that it is very difficult to stall in normal use.

Still another object of the invention is the provision of a magnetic control assembly cooperating with a multiplicity of diaphragm valve assemblies for controlling the passage of fluid through the fluid drive motor to effect reciprocation of a power output shaft to which may be connected selected utilization devices that operate by a reciprocating motion.

The invention possesses other objects and features of advantage, some of which, with the foregoing, will be apparent from the following description and the drawings. It is to be understood, however, that the invention is not limited to the embodiment illustrated and described since it may be embodied in various forms within the scope of the appended claims.

In terms of broad inclusion, the fluid drive motor forming the subject matter of this invention, when used with water as the driving fluid, is adapted to be connected to the outlet end of a conventional garden hose which delivers water at a pressure of about 45 pounds per square inch (psi) from an appropriate source. Obviously, other fluids than water, such as air, may be used, and other pressures above and below the 45 psi typical pressure of a residential water system may be used. Surprisingly, the inlet water that drives the fluid driven motor, after use, may be channeled out of the motor unit and into a storage receptacle or channeled to some other appropriate use instead of being wasted. Structurally, fluid from a hose is admitted to a motor block within which are contained a pair of double-acting pistons arranged in an assembly including and connected by a toothed rack which reciprocates with the pistons. Reciprocation of the toothed rack effects actuation of a drive assembly including a pinion fixed to a drive shaft rotated by rotation of the pinion. A channel block is provided associated with the motor block to channel fluid from and to the motor block depending upon the direction of displacement of the double-acting piston assembly within the motor block. Mounted on the channel block is a valve block which operates in conjunction with a magnetic control assembly to actuate a diaphragm valve assembly on the valve block to channel fluid from one end of the piston assembly to the other to effect the reciprocating displacement of the double-acting piston assembly. Bypass ports are provided in conjunction with selected diaphragm valves of the diaphragm valve assembly to prevent the motor from "locking up" hydraulically during an excursion of the piston assembly, thus insuring reliability of operation of the motor. One end of the drive shaft on which the pinion gear is mounted is utilized for mounting a utilization device such as a brush when it is desired to utilize the fluid drive motor for reciprocating a scrub brush. Other utilization devices such as a pad of sanding paper, or other abrading or polishing device may of course be mounted on the reciprocable output shaft since the fluid motor may be operated and the utilization device reciprocated without the release of fluid onto the surface being abraded or polished.

DETAILED DESCRIPTION OF THE PREFERRED EMBODIMENT

Figure 2:
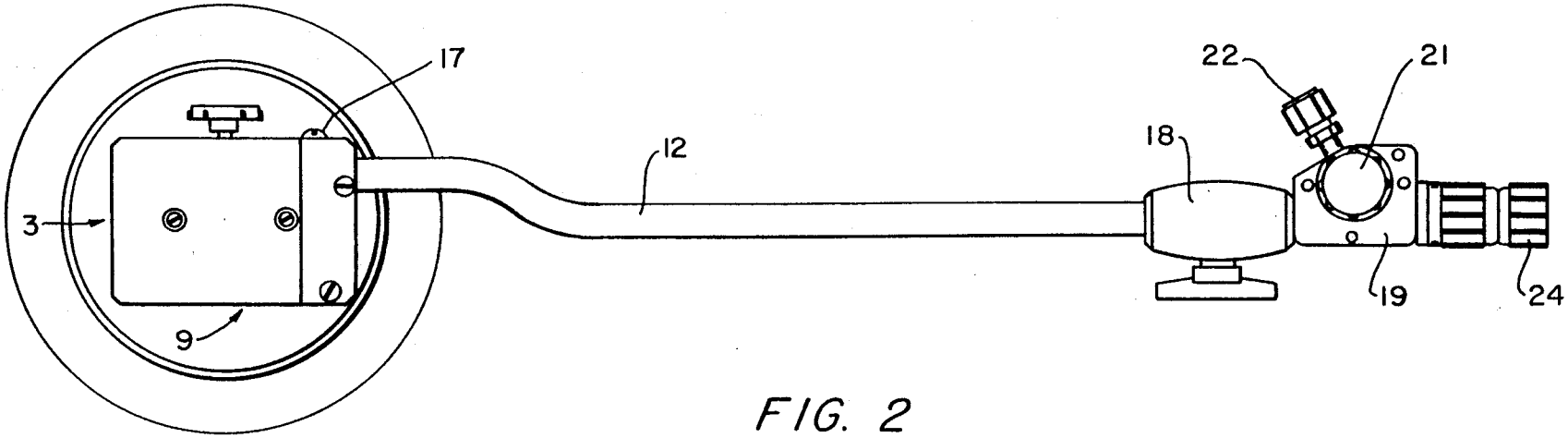
FIG. 2 is a plan view of the assembly illustrated in FIG. 1.
Figure 1:
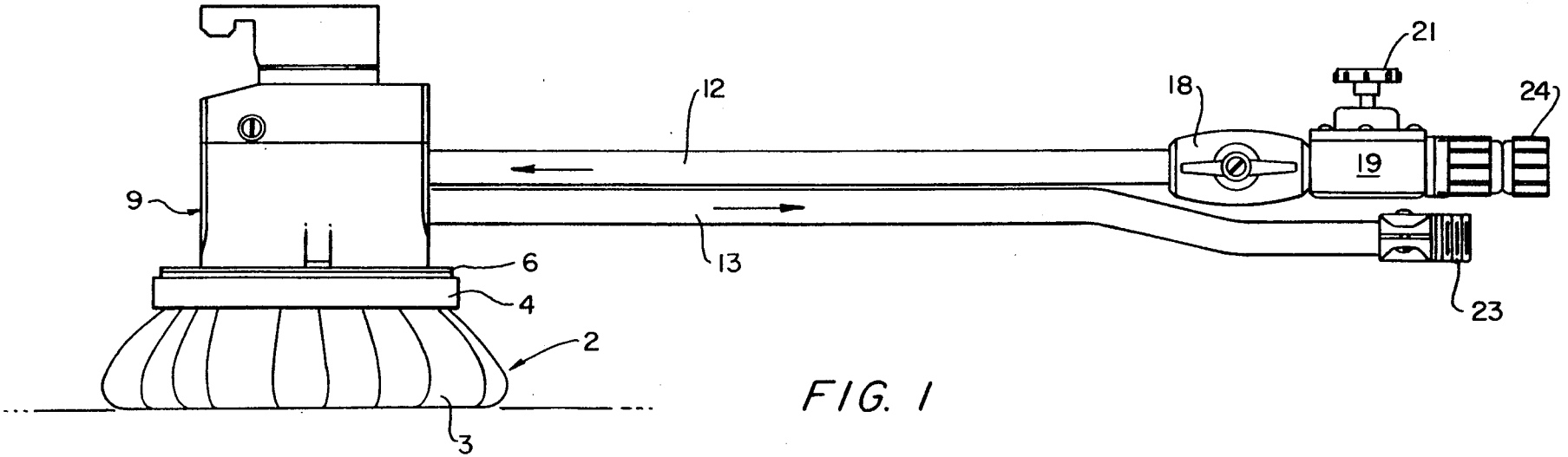
FIG. 1 is a side elevational view of the fluid drive motor equipped with a scrubbing device shown in an attitude of use on a flat surface, shown by the broken line.
Figure 3:
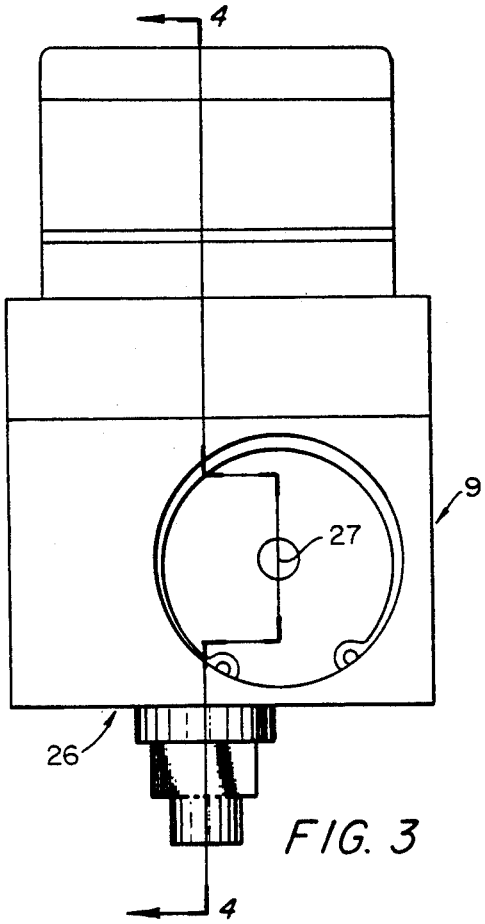
FIG. 3 is an end elevational view of the motor unit taken in the direction indicated by the arrow 3 in FIG. 2, shown apart from the scrub brush.
Figure 4:
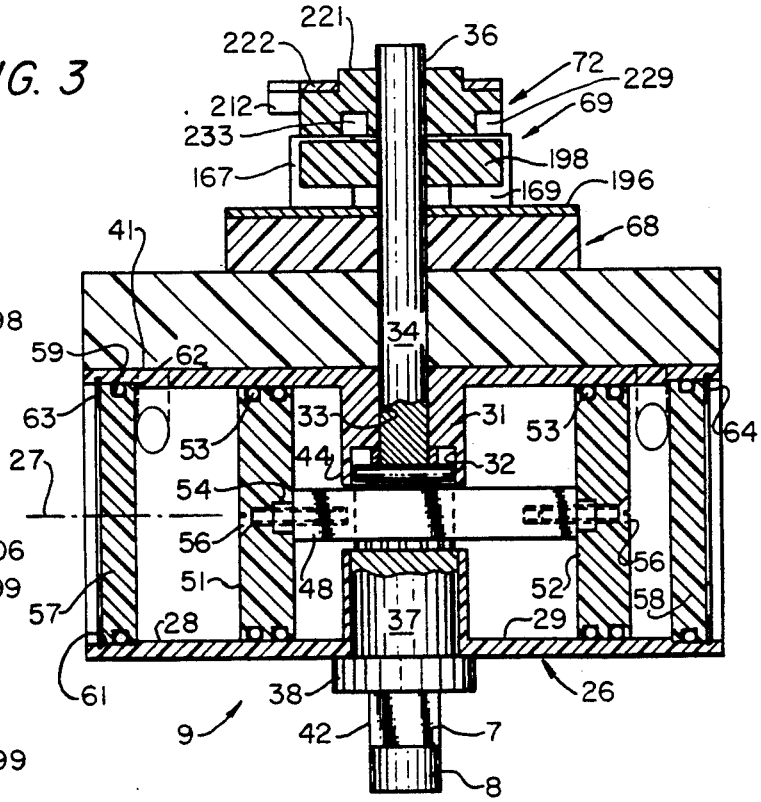
FIG. 4 is a vertical cross-sectional view taken in the plane indicated by the line 4—4 in FIG. 3.

In terms of greater detail, the scrubbing device and fluid motor therefor forming the subject matter of this invention is shown in assembled form in FIGS. 1 and 2. As there shown, the scrubbing device portion of the assembly includes a scrub brush designated generally by the numeral 2, and constituting selected bristles 3, arranged in a circular pattern and mounted on an annular plate 4. The annular plate 4 in turn is mounted below a guard plate 6 fixedly mounted above the annular plate 4, the latter having an oblong central aperture adapted to snugly fit a complementary configured drive portion 7 on the drive shaft 8 projecting from the motor unit 9 (FIG. 4). The guard plate is fixed to the motor unit and prevents the fingers from contacting the rotating plate 4 during normal use. Also projecting from the motor unit 9 are a pair of conduits 12 and 13 shown in FIGS. 1 and 2, the ends of the conduits associated with the motor unit 9 being sealingly yet detachably secured within appropriate receptacle bores 14 and 16, respectively, the conduits being releasably secured to the motor unit by an appropriate screw 17 threaded into the block and abutting the outer peripheries of the inner end portions of the conduits as shown in FIG. 13.

Referring to FIG. 1, at its end opposite the motor unit 9, the conduit 12 is provided with a shut-off valve 18 having an appropriate handle as shown, and a diverter valve 19 controlled by a knob 21 for diverting fluid from the inlet conduit 12 to an auxiliary outlet port 22 from which fluid, such as water, may be selectively emitted for the purpose of rinsing an area that has been scrubbed when water is used as the drive fluid.

In order that fluid that is directed to the motor unit through the inlet conduit 12 not be lost and thereby wasted, the outlet conduit 13 channels such fluid from the motor unit to a hose bib 23 that may appropriately be connected to a hose or other conduit directed to a salvage tank or receptacle for collecting fluid discharged from the motor unit. Fluid is input to the motor unit through the conduit 12 which at its end remote from the motor unit is provided with a freely rotatable gland connector member 24 of the type that may be connected to the discharge end of a common garden hose (not shown). With the shut-off valve 18 positioned as indicated by the handle in FIGS. 1 and 2, inlet fluid under pressure from an appropriate source enters the conduit 12 and passes into the inlet bore 14 formed in the motor block designated generally by the numeral 26.

Figure 11:
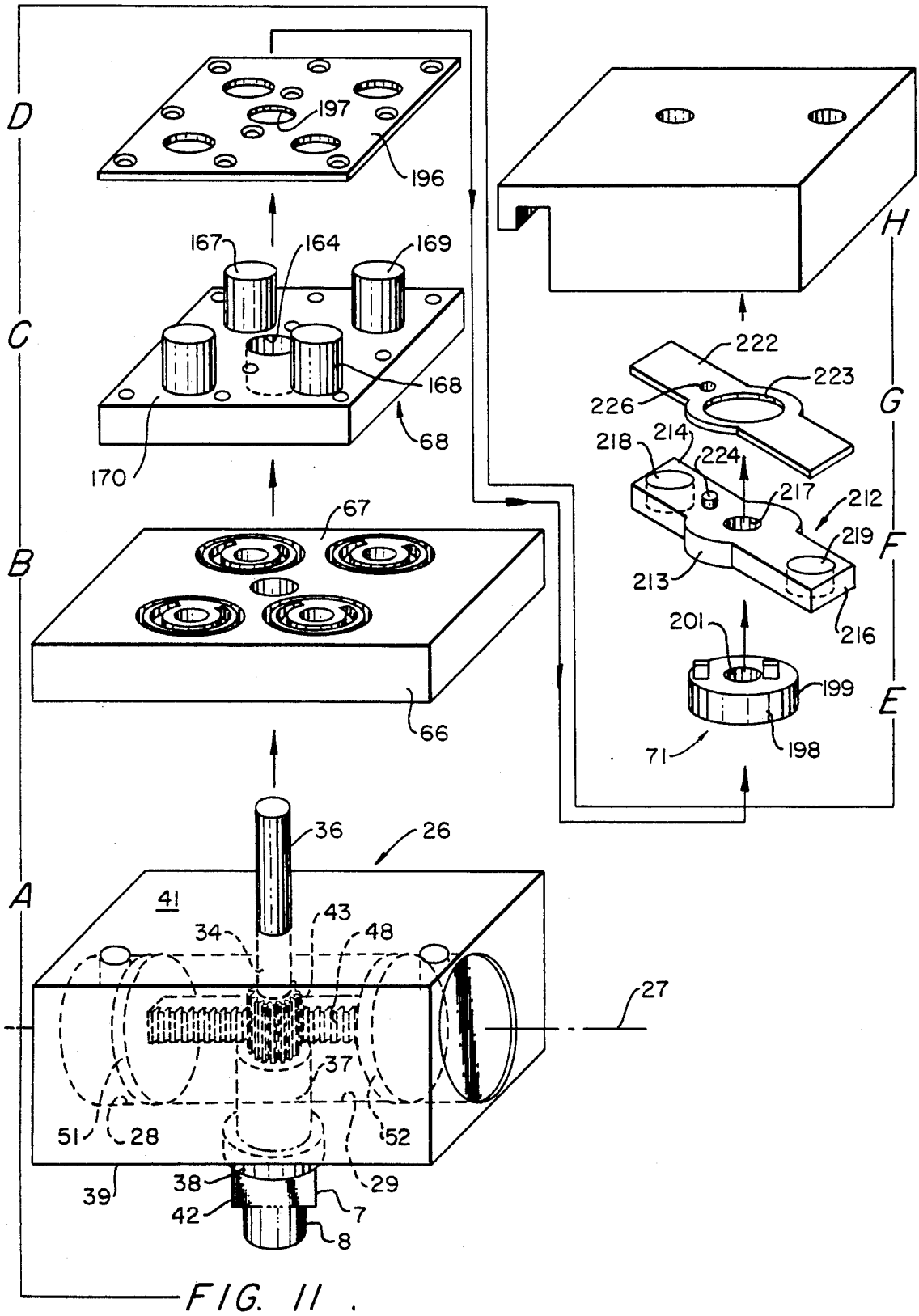
FIG. 11 is a composite, largely schematic, view showing the various parts of the fluid drive motor in exploded form. In the interest of clarity, the scrub brush is omitted.
Figure 12:
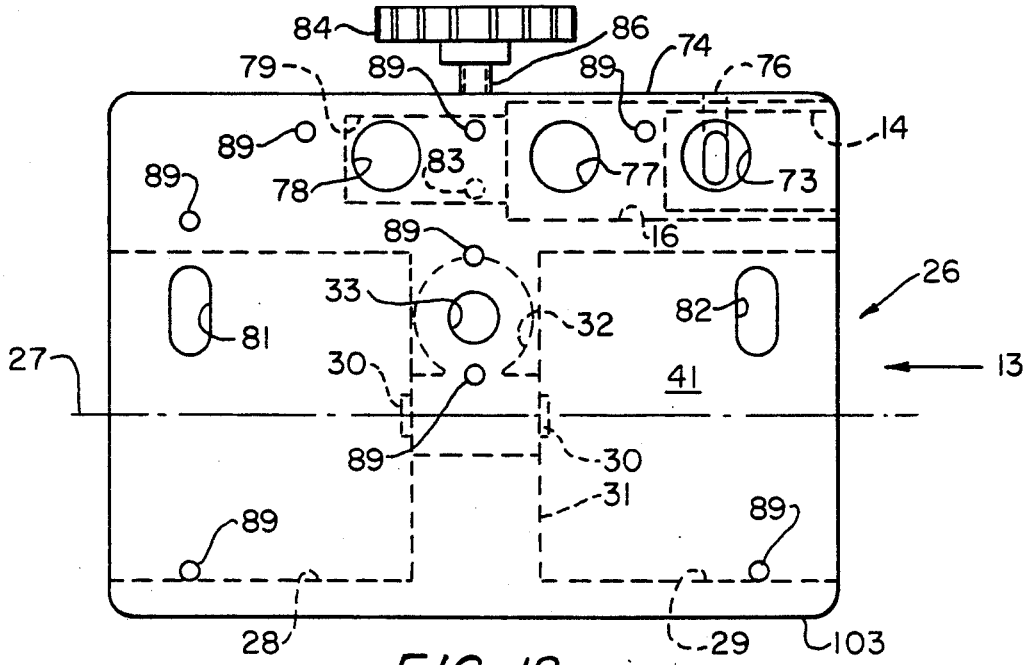
FIG. 12 is a plan view of the motor block with channel and valve blocks removed to reveal underlying structure.
Figure 13:
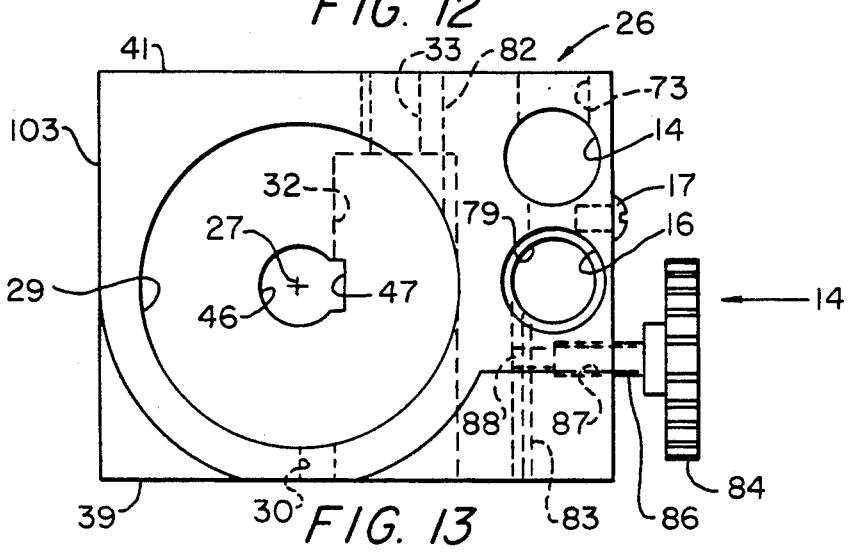
FIG. 13 is an end elevational view of the motor block of FIG. 12 taken in the direction of the arrow 13 in FIG. 12.
Figure 14:
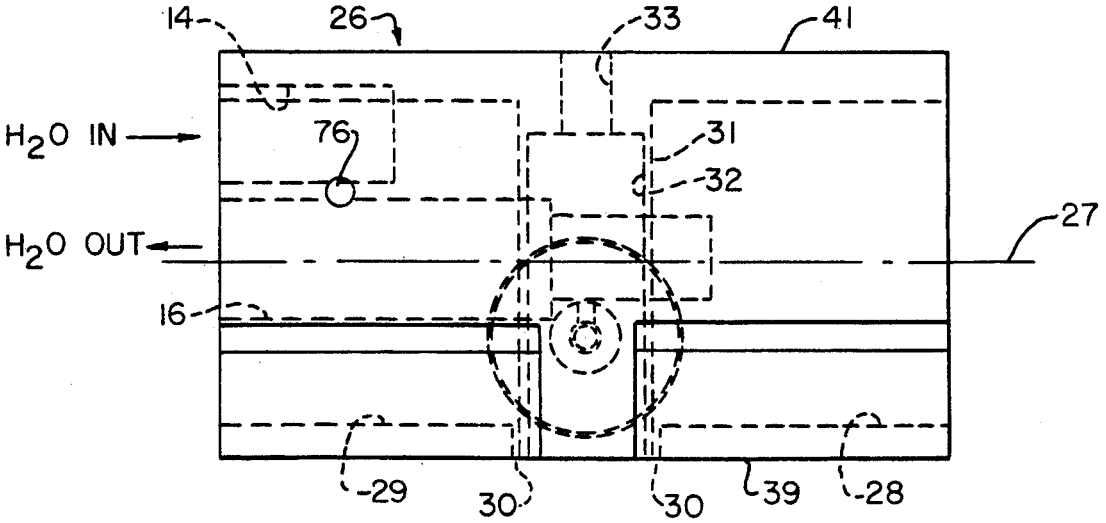
FIG. 14 is a side elevational view of the motor block taken in the direction of the arrow 14 in FIG. 13. For clarity, the control knob is omitted.

Referring to FIGS. 12, 13 and 14, it will be seen that the motor block 26 is generally quadrilateral in its configuration, is conveniently fabricated from a synthetic resinous material that is capable of being injection molded, and possesses a longitudinal axis 27 about which are symmetrically formed a pair of axially aligned yet separated piston cylinders 28 and 29, each cylinder being provided with a weep passageway 30 as shown in FIGS. 12, 13 and 14. The piston cylinders 28 and 29 are separated within the body block 26 by an intermediate wall 31 integral with the body block 26 and having a transverse bore 32 therethrough of relatively large diameter as indicated in FIGS. 4, and 12–14, the bore 32 serving to rotatably support the shaft 8, the portion within the bore 32 being sized to rotatably fit the bore, with appropriate tolerances for such rotation, while an extension 33 of the bore 32 of smaller diameter is adapted to rotatably support and form a journal for the reduced diameter portion 34 of the shaft 8, which continues in its extension out of the motor block 26 in an end portion 36. As illustrated in FIGS. 4 and 11, the enlarged portion 37 of the shaft 8 is snugly received in the relatively larger bore 32 of the intermediate wall 31, and lies next adjacent a circular flange 38 one side of which rotatably abuts the bottom surface 39 of the motor block 26. As indicated in FIGS. 4 and 12–14, the portion 34 of the shaft 8 lies rotatably journaled within the relatively smaller bore 33 constituting an extension of the large bore 32, and the end portion 36 of the shaft 8 exits from the motor block through the top surface 41 thereof. Referring to FIGS. 4 and 11, it will be seen that the drive shaft 8 in the area immediately adjacent to the circular flange 38 is provided with a drive portion 7 having flat sides 42 as indicated.

Within the motor block, and more specifically within the large bore 32 that extends into the intermediate wall 31 of the motor block, there is mounted on the drive shaft 8 a pinion gear 43 secured to the shaft 8 by an appropriate pin 44 so that when the shaft 8 rotates, the pinion also rotates at the same speed. In addition to the transverse bores 32–33 formed in the motor block 26, there is also formed an axially extending bore 46 one peripheral surface of which is relieved as at 47 (FIG. 13) to provide for the passage, in an axial direction, of the toothed rack 48 shown in FIGS. 4 and 11. The toothed rack 48, suitably reinforced by a slide bearing 49 secured to the toothed rack, is configured to slidably fit snugly in a complimentarily configured bore formed in the intermediate wall, which forms a journal for the toothed rack and slide bearing assembly, lending stability to the axial translation of the toothed rack as will hereinafter be explained. Additional stability is provided the axial translation of the toothed rack by connecting opposite ends of the toothed rack to pistons 51 and 52 adapted to extend transversely across the piston cylinders 28 and 29, respectively, each of the pistons 51 and 52 on its outer periphery being provided with appropriate 0-rings 53 which effectively seal the union between the inner peripheries of the piston cylinders 28 and 29 and the outer peripheries of the pistons 51 and 52 against the passage of fluid thereby while permitting axial translation of the pistons 51 and 52, resulting in axial translation of the toothed rack 48 and rotation of the shaft 8. As shown in FIG. 4, each end of the toothed rack 48 is provided with an axially extending boss 54 recessed into the associated face of the pistons 51 and 52, and the rack 48 is fixed to the pistons 51 and 52 by appropriate screws 56.

To constitute each of the piston cylinders 28 and 29 a fluid-tight cavity, the outer ends of the piston cylinders 28 and 29, respectively, are sealed by seal walls 57 and 58, each of the seal walls being of somewhat larger diameter than the pistons 51 and 52, and each being provided with an O-ring seal 59 that seals the union between the outer peripheries of the seal walls 57 and 58 with the cylinder wall portion 61 in which each of the seal walls 57-58 is seated. The somewhat larger diameter of the seal wall 61 than the piston cylinders 28 and 29 provides a shoulder 62 against which each of the seal walls 57 and 58 may abut, and the seal walls 57 and 58 are retained against the shoulder by appropriate snap rings 63 and 64.

In the preferred embodiment disclosed and illustrated herein, fluid pressure is applied to the pistons 51 and 52 to effect axial translation thereof with consequent axial translation of the toothed rack 48, which causes rotation of the pinion 43 and consequent rotation of the drive shaft 8 to drive the scrubbing device 2 illustrated in FIGS. 1 and 2. To effect such rotative reciprocation of the scrub device 2, it has been found that fluid pressure, as from water, operating under the conventional pressures utilized in residential environments, or even higher pressures of the type used in industrial environments, may be admitted to the piston cylinders 28 and 29 between the seal walls 57 and 58 and the pistons to effectively control axial reciprocation of the piston, rack and pinion assembly to thereby effect reciprocating rotation of the drive shaft 8 to drive the scrub device 2.

To achieve rotational reciprocation of the drive shaft 8 to thus drive the scrub device 2, or any other utilitarian structure that might be attached to the drive shaft 8, the motor block 26 is provided with certain ports and passageways which operate to permit the entry and egress of fluid under pressure into and through the motor block 26 and into and through the lower channel block designated generally by the numeral 66 and thence into and through the upper channel block designated generally by the numeral 67, as illustrated in FIGS. 15-19.

Figure 21:
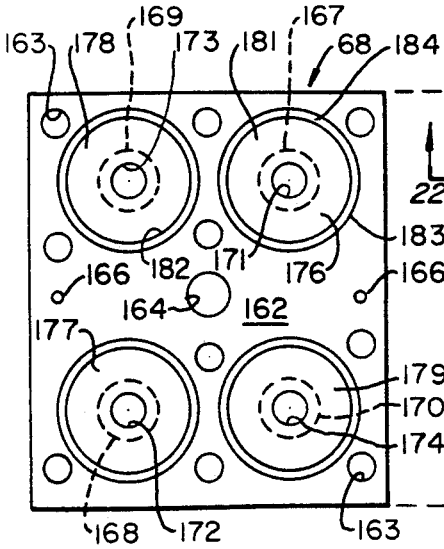
FIG. 21 is a bottom plan view of the valve block illustrated in FIG. 20.
Figure 20:
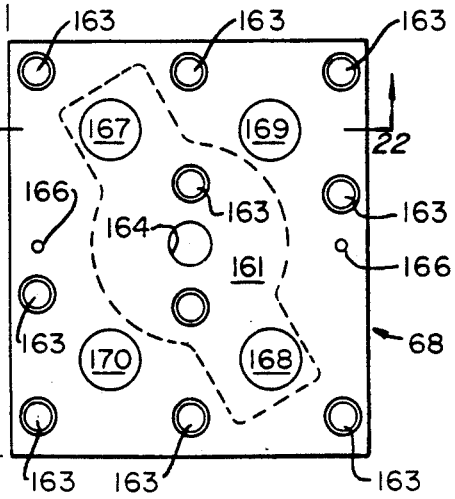
FIG. 20 is a top plan view of the valve block adapted to be superimposed over the channel block portion shown in FIG. 17, with the magnet bar assembly shown in "phantom" outline.

Referring to FIG. 11, the lower and upper channel blocks 66 and 67, respectively, are shown substantially schematically as one single unit in the exploded view, but for purposes of clarity in this description and for clarity in the illustrations, and as a practical matter for manufacturing purposes, the lower and upper blocks 66 and 67, respectively, are initially separate blocks that are disposed one above the other in sealing relationship so that certain passages and ports within the two blocks overlap and permit the passage of fluid therethrough. For this purpose, the upper and lower channel blocks are "welded", and between the lower channel block and the motor block 26, appropriate gaskets (not shown) are inserted to effect the sealing relationship required to permit the desired flow of fluid. Illustrated in FIGS. 20 and 21 is a valve block 68 that is adapted to be superimposed over the upper channel block 67 oriented so that valves disposed between the valve block and the upper channel block 67 may be actuated by an appropriate control mechanism designated generally by the numeral 69, including generally a rotor 71 fixed for rotation with the end portion 36 of the shaft 8, and a magnet assembly designated generally by the numeral 72, all of which components cooperate one with the other to control the fluid pressure applied against the pistons 51 and 52 to thereby control axial translation of such pistons and the attached rack 48, the pinion 43 and the drive shaft 8.

Referring again to FIGS. 12 through 14, it will be seen that the motor block 26 is provided with an inlet fluid distribution bore 73 that extends vertically through the motor block 26 to intercept the inlet bore 14 within which is sealingly inserted the inlet end of the conduit 12. At its opposite end, the fluid distribution bore 73 emerges or intercepts the top surface 41 of the motor block 26. Since the inlet bore 14 is separated from the outlet bore 16, and since it is necessary to provide some means for retaining the O-ring equipped ends of the inlet and outlet conduits in the bores 14 and 16, respectively, there is provided on the side face 74 of the motor block a threaded bore 76 into which the retention screw 17 may be threaded, the inner end of the retention screw 17 extending between the inner ends of the conduits 12 and 13 and releasably yet sealingly securing them to the motor block 26.

Also formed in the motor block 26 are two additional bores 77 and 78, these two bores being generally parallel to the inlet fluid distribution bore 73, but spaced axially therefrom and formed in the motor block 26 so that they intersect the top surface 41 thereof and extend into the motor block to intersect the bore 16 in the case of the bore 77, and to intersect an extension 79 of the bore 16 in the case of bore 78. It will of course be obvious from FIG. 12 that the bores 73, 77 and 78 are essentially perpendicular to the top surface 41 of the motor block, while the bores 14, 16 and 79 are essentially parallel to the long axis of the motor block and parallel also to the side surface 74. The function of these bores will be explained hereinafter in conjunction with the description of the lower channel block 66 shown in FIG. 15. Because it is necessary to admit fluid under pressure to the piston cylinders 28 and 29, there is formed in the motor block 26, again penetrating the top surface 41, and communicating with the interiors of the piston cylinders 28 and 29, respectively, passageways 81 and 82, the passageway 81 communicating with the piston cavity defined by the piston cylinder 28, while the passageway 82 communicates with the interior of the piston cavity defined by the piston cylinder 29. Both passageways 81 and 82 function as fluid ingress and egress passages into the corresponding piston cavities in a manner which will hereinafter be explained.

In the operation of fluid motors, especially those operated with water, it is sometimes desirable to be able to squirt a quantity of water on the surface being scrubbed without stopping operation of the scrub device. To enable that occurring in connection with the subject invention, there is provided in the motor block 26 a small diameter bore 83 that penetrates into the block generally perpendicular to the axis of the bore 16, through the bottom wall 39, and which intersects the interior of the bore extension 79 as seen in FIGS. 12 and 13. The egress of water through the bore 83 is controlled b a knob 84 having a threaded shaft 86 that threadably penetrates a complimentarily threaded bore 87 formed in the motor block as illustrated. The inner end of the threaded shaft 86 is provided with an extension 88 that intersects the bore 83 to normally prevent egress of water through the bore 83. However, when desired, the knob 84 may be digitally manipulated to retract the shaft 86 from its threaded bore and to thereby open the bore 83 to permit the release of water from the bore extension 79.

Inasmuch as the lower channel block 66 must be fastened directly to the top surface 41 of the motor block 26, with an appropriate gasket or gaskets such as O-rings disposed therebetween, there are provided in the top surface 41 of the motor block eight small diameter bores 89 into which mounting screws may be driven to tightly retain the lower channel block 66 in sealing engagement with the motor block 26. We have found that one method of providing such gasketing means is to provide appropriate O-rings (not shown) suitably seated in rabbeted recesses 91 formed in the lower surface 92 of the lower channel block 66, the recesses 91 obviously being formed about the perimeters of passageways formed in the lower channel block as will hereinafter be explained.

Figure 15:
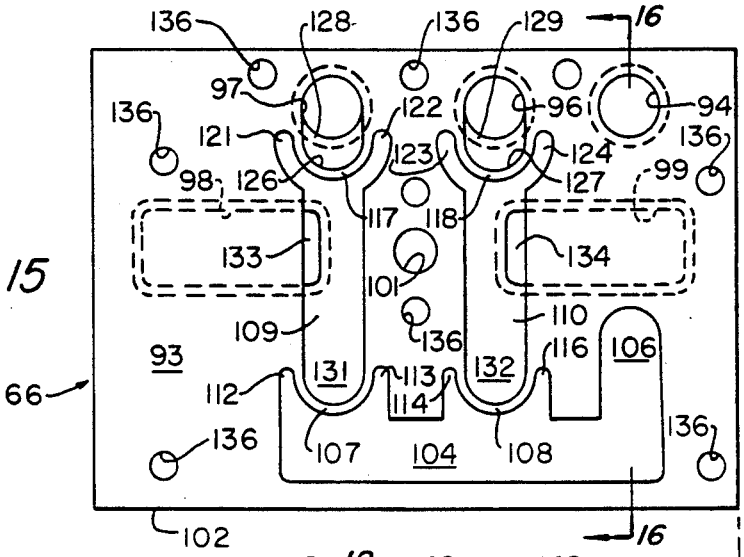
FIG. 15 is a plan view of the lower portion of the two-part channel block illustrating the arrangement of passageways therein.
Figure 16:
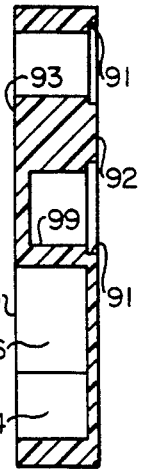
FIG. 16 is a vertical cross-sectional view taken in the plane indicated by the line 16—16 in FIG. 15.

As illustrated in FIGS. 15 and 16, the lower channel block portion 66, is provided with a flat lower surface 92 that coincides closely to the flat upper surface 41 of the motor block 26. The lower channel block portion 66 is approximately one-half inch in thickness, and is provided with a smooth upper surface 93 parallel to the lower surface 92, and the lower channel block portion 66 is provided with three through-bores 94, 96 and 97 which correspond in spacing so that when the channel block 66 is placed over the motor block 26, these bores coincide with the bores 73, 77 and 78, respectively, formed in the motor block. Additionally, there is formed in the lower surface 92 of the channel block portion 66, two elongated passageways 98 and 99 as shown in FIG. 15, the elongated passageways 98 and 99 extending axially of the lower channel block portion 66 and generally being aligned with a central bore 101 adapted to receive and form a journal for the shaft: portion 34 of drive shaft 8.

Formed in the top surface 93 of the lower channel block portion 66 extending substantially parallel to one long side 102, which itself lies superimposed and coincident with the side 103 of the motor block, is an elongated passageway 104 which at one end is provided with a right angle section 106 as shown. Projecting into the elongated passageway 104 are a pair of laterally spaced arcuate wall portions 107 and 108 which form the terminal ends of transversely extending and generally elongated passageways 109 and 110. It should be understood that the elongated passageways 104, 109 and 110 do not extend all the way through the full thickness of the lower channel block portion 66. Rather, they have a depth as illustrated in FIG. 16 in relation to the elongated passageway 104 and the right angle extension 106. As illustrated in FIG. 15, the end walls 107 and 108 of the passageways 109 and 110 are generally semi-circular, forming lateral extensions 112 and 113 of the passageway 104. In like manner, the end wall 108 associated with the passageway 110 forms lateral extensions 114 and 116, thus forming the walls 107 and 108 in a generally semi-circular configuration.

At the opposite end of the passageways 109 and 110, i.e., those ends of the passageways 109 and 110 associated with the through-bores 96 and 97, each of the passageways 109 and 110 is diverted laterally by semi-circular wall portions 117 and 118 projecting into the passageways 109 and 110 to define arcuate bays 121 and 122 about the wall portion 117, and arcuate bays 123 and 124 about the wall portion 118 as shown. The wall portions 117 and 118 are formed in the body of the lower channel block portion 66 by forming off-center recesses 126 and 127 through the top surface 93 of the channel block to a depth sufficient to leave a bottom wall portion 128 associated with the bore 97, and a wall portion 129 associated with the bore 96. It will thus be seen from FIG. 15, that the transversely extending passageways 109 and 110 possess a depth from the top surface 93 so as to provide bottom walls 131 and 132 therein, and that the elongated passageways 98 and 99, formed in the lower channel block portion 66 from the under surface or under side 92 of the block, intersect the associated passageways 109 and 110 respectively, to provide communicating apertures 133 and 134 therebetween. Also provided in the lower channel block portion 66 are mounting holes 136 through which appropriate mounting screws extend to sealingly bind the lower channel block 66 to the top surface of the motor block 26.

It will thus be seen that when the lower channel block portion 66 is superimposed over the motor block 26 so that the bores 94, 96 and 97 formed in the channel block correspond with bores 73, 77 and 78, respectively, formed in the motor block, the elongated apertures or passageways 81 and 82 formed in the motor block which give access to the piston chambers 28 and 29 communicate with the interior of the passageways 98 and 99 formed in the underside 92 of the channel block, which passageways 98 and 99 in turn, communicate through apertures 133 and 134 with the passageways 109 and 110. However, it should be noted that within the confines of the lower channel block portion 66 there is no connection between the inlet fluid distribution port 94 and the elongated channel 104 and its right angle extension 106. Neither is there a connection within the confines of the lower channel block portion 66 between the inlet fluid distribution port 94 and the axially extending passageways 98 and 99 formed in the undersurface 92 of the channel block, or the transversely extending passageways 109 and 110 formed in the top surface 93 of the channel block portion 66. To form an interconnection between these passageways, it is necessary to apply the upper channel block portion 67 in a superimposed relationship over the top surface 93 of the lower channel block portion 66 in a manner which will now be explained.

Figure 19:
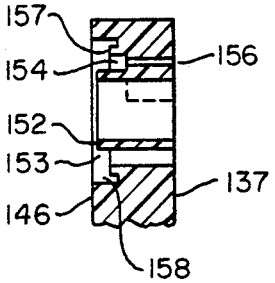
FIG. 19 is a fragmentary vertical cross-sectional view taken in the plane indicated by the line 19—19 in FIG. 17.
Figure 17:
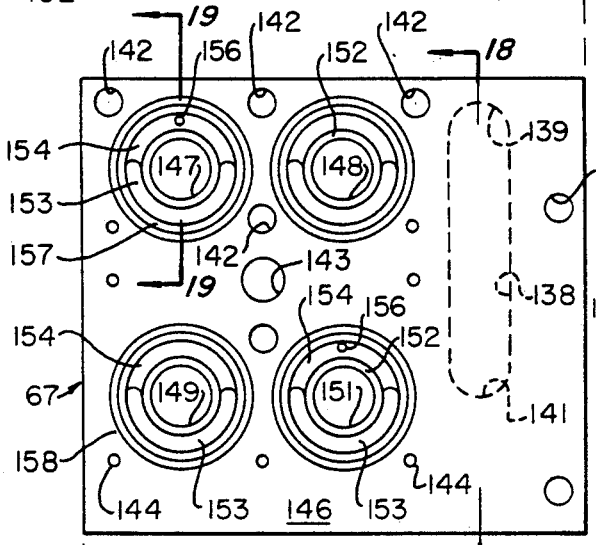
FIG. 17 is a plan view of the upper portion of the two-part channel block illustrating the valve ports and other passageways that cooperate with the passageways formed in the lower channel block portion illustrated in FIG. 15.
Figure 18:
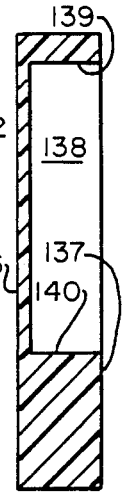
FIG. 18 is a vertical cross-sectional view taken in the plane indicated by the line 18—18 in FIG. 17.

Referring to FIGS. 17, 18 and 19, it will be seen that the upper channel block portion 67 is substantially square in plan, as viewed full size in FIG. 17, and possesses a thickness of approximately nine-sixteenths of an inch. Formed in the underside surface 137 of the upper channel block portion 67 is an elongated passageway 138 having a generally square cross-section and curved ends 139 and 141 possessing essentially the same radius of curvature as the inlet water distribution bore 94 of the lower channel plate portion 66, with the end 141 of the channel 138 having a curvature that complements the radius of curvature of the end of the right angle extension 106 of the channel 104 in the lower channel block portion 66. As with the lower channel block portion 66, the upper channel block portion 67 is provided with mounting holes 142 that coincide in placement with the complementary mounting holes 136 formed in the lower channel block portion 66. Additionally, the upper channel block portion 67 is provided with a through-bore 143 which corresponds or complements the through-bore 101 formed in the lower channel block portion 66 when the channel block portion 67 is superimposed over the channel block portion 66. The through-bore 143 provides a journal and passage for the bearing portion 34 of the drive shaft extension portion 36. The smaller diameter blind bores 144 seen in FIG. 17, are adapted to receive mounting screws utilized to secure the valve block 68 to the upper surface 146 of the upper channel block portion 67 in a manner which will hereinafter be explained.

Referring again to FIG. 17, it will be seen that the upper channel block portion 67 is also provided with a series of four through-bores 147, 148, 149 and 151. Each of the through-bores is defined by a cylindrical wall 152 that extends nearly the full depth of the channel block, the upper end of the cylindrical wall member 152 as shown in FIG. 19 terminating just short of the top surface 146 for a reason that will hereinafter be explained. Each of the cylindrical wall portions 152, is bounded through approximately 180 degrees by a semi-circular channel 153 that extends through the full thickness of the channel block and intercepts both the bottom surface 137 and the top surface 146 as shown in FIGS. 17 and 19. The remaining substantially 180 degrees of arc of the channel 153 is provided with a floor 154 substantially recessed to about the median plane of the thickness of the channel block as illustrated in FIG. 19, there being a small anti-lockup bore 156 extending through the floor of the channel and communicating with the channel on the one hand and intersecting the lower surface 137 of the block on the other hand as shown in FIG. 19. The passageway 153 and channel 154 circumscribe the cylindrical wall portion 152, and are themselves circumscribed by a circular wall 157 the upper end of which terminates short of the upper end of the cylindrical wall portion 152 as shown in FIG. 19. The cylindrical wall 157 is surrounded by an annular seal channel 158 for purposes which will hereinafter be explained. It should be noted that the small bore 156 formed in the bottom of channel 154 is associated only with two of the four bores illustrated in FIG. 17, these being through-bores 147 and 151 as shown. The function of the small bores 156 is to prevent hydraulic lock-up of the motor assembly as will hereinafter be explained.

While we have illustrated the lower channel block portion 66 and upper channel block portion 67 as separate components for the purpose of clarity in understanding the various passages that are formed in each of the channel blocks, it should be understood that the upper channel block 67 is adapted to be superimposed over the lower channel block portion 66 so that the mounting holes 142 of the upper channel block portion 67 coincide with the mounting holes 136 of the lower channel block portion 66 as previously described. These two channel blocks are manufactured in separate form as illustrated and described, but upon assembly of the device, the upper channel block 67 when superimposed over the lower channel block 66 is permanently secured to the lower channel block 66 by application of an appropriate "welding" compound (not shown) between the lower surface 137 of the upper channel block portion 67 and the upper surface 93 of the lower channel block portion 66.

We have found that it is preferable to effectively "weld" these two surfaces together in order to create a fluid-tight union between the mating surfaces of the two channel blocks rather than attempt to seal the passageways between the two channel blocks through use of gaskets or O-rings. When thus superimposed, it will be seen that the elongated slot 138 formed in the underside of the upper channel block portion 67 communicates at the end 139 with the inlet fluid distribution bore 94, thus admitting fluid under pressure into the channel 138. Since the opposite end of the channel or passageway 138 complements the curvature of the right angle extension 106 of the passageway 104 in the lower channel block portion 66, it will be seen that fluid is thus permitted to pass through the passageway 138 into the longitudinally extending passageway 104.

In its superimposed position on the lower channel block portion 66, the cylindrical walls 152 surrounding the through-bores 149 and 151 coincide with and are sealed to the semi-circular end walls 107 and 108, the radius of curvature of these latter end walls 107 and 108 corresponding to the radius of curvature of the cylindrical walls 152. Thus, since the arcuate passageways 153 that partially surround the cylindrical walls 152 for bores 149 and 151 communicate with the longitudinally extending passageway 104, fluid from this passageway passes upwardly through the semi-circular passageways 153 in preparation for actuation of appropriate valve structures, as will hereinafter be explained, to permit the fluid to flow into the transversely extending passageways 109 and 110. Suffice at this point in the description to note that fluid that does pass into the transverse passageway 109 continues transversely therealong to fill the semi-circular lateral extensions or bays 121 and 122 surrounding the semi-cylindrical wall portion 117 associated with the through-bore 97 in the lower channel block portion 66, while fluid surging into the transverse passageway 110 passes therealong and fills the transversely diverted bays 123 and 124 associated with the semi-cylindrical wall 118 and the through-bore 96.

It should be understood at this point that the through-bores 97 and 96 constitute exhaust ports that communicate ultimately with the outlet conduit 13, and that since the transversely extending passageways 109 and 110 are also in communication with the longitudinally extending passageways 98 and 99, respectively formed in the underside of the channel block portion 66, fluid also passes appropriately through the communicating apertures 133 and 134 upon being released by appropriate valve operation, so as to be admitted from the passageways 98 and 99 into the piston cylinders or cavities 28 and 29 to thus control axial displacement of the piston assembly. When the piston cylinder 28 is pressurized by the admission of fluid thereto by appropriate actuation of valve mechanisms to be hereinafter explained, the exhaust port 96 is open to permit the egress of fluid from behind the piston in piston chamber 29. The valving arrangement is such that approximately 288 reciprocations per minute occur under very close control of the magnet assembly 69 which operates to closely control the opening and closing of the valves in the valve block as will now be explained.

Figure 22:
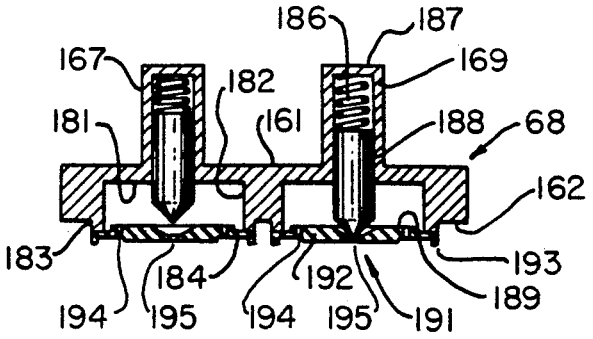
FIG. 22 is a vertical cross-sectional view through two of the valve mechanisms, illustrating one valve (right) in closed condition and the other valve (left) in open position. The view is taken in the plane indicated by the line 22—22 in FIG. 20.
Figure 23:
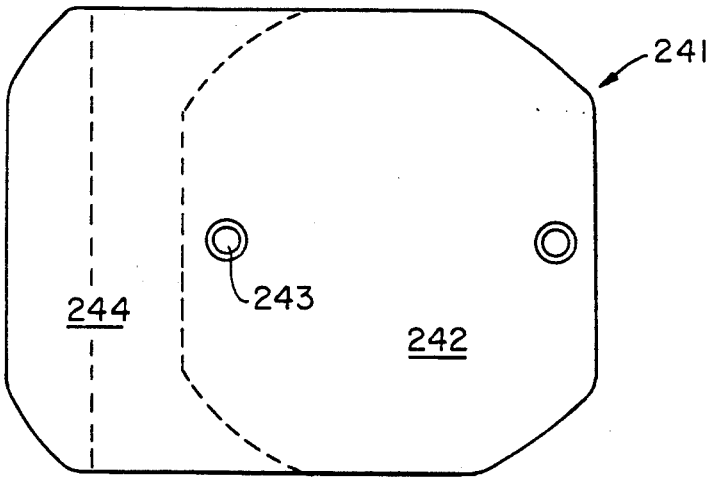
FIG. 23 is a top plan view of the cover block which mounts on the valve block to enclose the rotor and magnet assembly.
Figure 24:
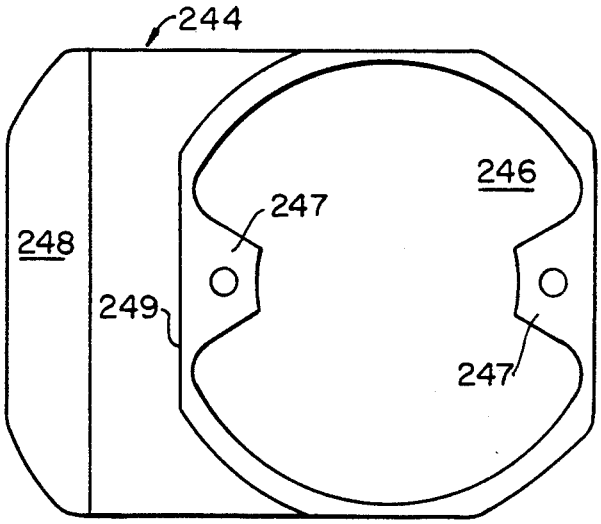
FIG. 24 is a bottom plan view of the cover block of FIG. 23, showing the abutments forming stops for the magnet assembly.

Referring to FIGS. 20, 21 and 22, it will be seen that the valve block is a substantially quadrilaterally configured member formed preferably from injection moldable synthetic resinous material, and shown approximately actual size in FIGS. 20, 21 and 22. The valve block comprises a generally flat plate having a thickness of approximately three-eighths of an inch, with a top surface 161 shown in FIG. 20, and a bottom surface 162 shown in FIG. 21. The valve block is provided with mounting holes 163 distributed as shown, and is also provided with a central bore 164 adapted to rotatably receive the projecting shaft extension portion 36 of the drive shaft 8. The two smaller bores 166 constitute pilot bores to receive the threaded shanks of mounting screws extending through the cap structure illustrated in FIGS. 11, 23 and 24, described hereinafter. From the top surface 161 of the valve block extend four perpendicular bosses 167, 168, 169 and 170. It should be noted that these perpendicular bosses that extend upwardly from the top surface 161 of the valve block define the corners of a rectangle, with the bosses 167–168 defining diagonally opposite corners of such rectangle and the bosses 169–170 defining the two remaining corners of the rectangle.

Referring to FIG. 21, this view illustrates the underside of the valve plate illustrated in FIG. 20, and shows the exterior peripheries of the bosses 167–170 in broken lines, and shows also that these bosses are each bored internally to provide cylindrical receptacles 171, 172, 173, and 174, corresponding, respectively, to the bosses 167, 168, 169 and 170.

As illustrated in FIGS. 21 and 22, there is also formed on the underside 162 of the valve block four cylindrical recesses 176, 177, 178 and 179, these recesses being associated, respectively, with the cylindrical receptacles 171, 172, 173, and 174 as shown. Each of the recesses is provided with a bottom wall and each of the recesses is identical with the others. As shown in FIGS. 21–22, the recesses are symmetrical about the central axis of the cylindrical receptacles which extend through and intersect the bottom wall 181 of each of the recesses. Each of the recesses is also provided with a cylindrical side wall 182 that continues upwardly from the bottom 181 beyond the surface 162 of the valve block to provide around each of the recesses a circular wall 183 having a top surface 184 that lies in a plane parallel to but above the plane of the bottom 162 of the valve block as illustrated in FIG. 22.

Disposed within each of the four receptacle bores, as illustrated in FIG. 22, is a coil compression spring 186 which abuts the closed end of the associated cylindrical receptacle, the opposite end of the coil compression spring abutting one end of a cylindrical ferromagnetic armature 188 slidably disposed within the cylindrical receptacle with which it is associated. The ferromagnetic armature is selectively responsive to an external magnetic field induced by the magnetic assembly designated generally by the numeral 72 in FIG. 4 and including rotor body 198 and magnet bar 212. The opposite end of the armature is conically formed and when the armature is not subjected to the attraction of the magnetic field, the conical point impinges against the centrally recessed back side 189 of a diaphragm valve designated generally by the numeral 191 and having a seal surface 192 on the side of the valve opposite the back side 189 against which the armature resiliently impinges. The outer periphery of the diaphragm valve member 191 is provided with a cylindrical flange 193 adapted to seat snugly in the annular channel 158 illustrated in FIG. 19 when the valve member 191 is applied to the upper channel block portion 67 so that each of the valve members overlies one of the ports or passageways 147, 148, 149 and 151. Thus, when the valve block 68 is superimposed over the upper channel block portion 67 with the four diaphragm valves applied thereto, and with the four springs 186 and four ferromagnetic armatures 188 in place, it will be seen that the circular surface 184 of the circular wall 183 formed on the underside of the valve block, impinges against the back side of the flexible diaphragm valve 191, i.e., on the side thereof opposite the cylindrical flange 193, and thus presses the flange sealingly into the annular channel 158.

It will thus be seen that with the diaphragm valves in place over each of the passageways 147, 148, 149 and 151, and with the valve block 68 superimposed thereover and clamped thereon to retain the valves in position, selected valves will be held in a normally closed condition by the effect of the coil compression spring 186 acting on the associated ferromagnetic armature of each of the valve assemblies not influenced by the magnetic circuit. The downward pressure of the conically pointed armature on the centrally apertured back side of the flexible diaphragm valve causes the seal surface 192 of each diaphragm valve to impinge on the upper end of the associated cylindrical walls 152 that define the bores 147–149 and 151, thus preventing fluid under pressure from passing through those bores until an appropriate magnetic field imposes a magnetic force on an armature in a selected manner to effect raising of the armature as illustrated on the left side of FIG. 22, to thus permit the fluid under pressure welling up through the semi-circular passageway 153 to raise the diaphragm valve, thus separating the seal surface 192 from the top surface 152 of the cylindrical wall surrounding the bores 147–149 and 151, thus permitting the fluid to flow into the bores 149 and 151 and from there into the transversely extending passageways 109 and 110. However, since the valve assemblies also normally close the bores 147 and 148, it requires an outside force to raise the armatures associated with these bores before fluid will flow from the transverse channels 109 and 110 and into the discharge ports 96 and 97 of the motor block.

To assist the coil compression springs 186 to retain the diaphragm valves closed, each of the diaphragm valves is provided with a pair of small apertures 194 formed in each valve radially outwardly from the seal surface 192. These apertures communicate the semi-circular passageways 153 with the recesses 176–179, and permit a small volume of fluid under pressure from the passageways 153 to fill the recesses, thus imposing full fluid pressure on the back side 189 of each valve in addition to the pressure exerted in the same direction by the spring-pressed conically pointed armature, the conical point of which seals the central aperture 195 in each valve when in contact therewith to prevent the passage of fluid through the aperture 195. Thus, when a magnetic force lifts the armature and removes the pressure of the spring, the central aperture 195 of the valve previously sealed by the conical point of the armature is opened and fluid flows through the central aperture out of the recess behind the diaphragm and into the port below. Since this relieves the pressure on the back side of the diaphragm valve, the fluid pressure on the seal surface side of the diaphragm valve fully opens the valve, allowing fluid to flow into the previously sealed associated bores 147–149 and 151.

Figure 8:
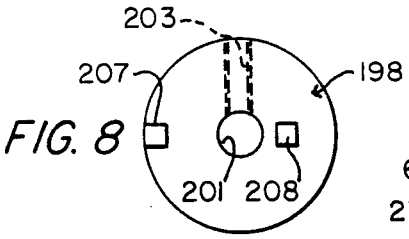
FIG. 8 is a top plan view of the rotor adapted for rotation with the drive shaft of the fluid motor and operatively associated, when assembled, with the mechanism illustrated in FIGS. 5–7 to effect reciprocation of the magnet assembly.
Figure 9:
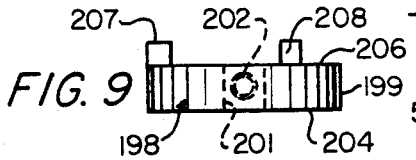
FIG. 9 is a side elevational view of the rotor structure illustrated in FIG. 8, shown apart from any other structure.
Figure 10:
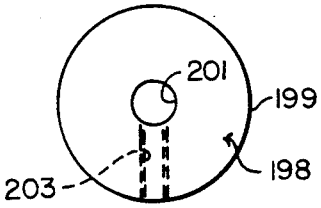
FIG. 10 is a bottom plan view of the rotor illustrated in FIGS. 8 and 9.

Referring to FIGS. 4–7, and 11, there is there shown a magnetic assembly designated generally by the numeral 69 in FIG. 4. A metallic clamp plate 196, apertured as illustrated is adapted to drop over the projecting bosses 147–149 and 151, and is apertured also as indicated to receive mounting screws (not shown) which clamp the valve block to the top surface of the upper channel block portion 67 as previously discussed. The clamp plate is also provided with a central aperture 197 through which projects the shaft extension 36 of the drive shaft 8. Mounted on the shaft extension 36 above the clamp plate is a cylindrical non-metallic rotor member designated generally by the numeral 198 and having a diameter such that the outer periphery 199 of the rotor lies just inside the outer peripheries of the upwardly extending bosses projecting integrally from the top surface 161 of the valve block 68. The rotor is provided with a central bore 201 by which the rotor is mounted on the shaft extension 36 by means of an appropriate set screw 202 extending radially from the outer periphery of the rotor through a threaded bore 203. The rotor is also provided with a lower surface 204 adapted to slidably rotate on the surface 161 of the valve block 68, and a top surface 206 from which project a pair of studs 207 and 208. As illustrated in FIGS. 8 and 9, the stud 207 projects upwardly from the upper surface 206 of the rotor and is positioned adjacent the outer periphery of the rotor. The stud 208 on the other hand is disposed between the central bore of the rotor and the outer periphery, the center of the stud 208 lying substantially midway between the center of rotation of the rotor and the outer periphery. While we have indicated above that the rotor may rest on the top surface of the clamp plate 196, obviously, the rotor may be spaced therefrom a small amount to reduce frictional resistance between the plate 196 and the underside of the rotor. This relationship is illustrated in FIG. 4. Alternatively, the clamp plate 196 may be omitted and the clamp screws applied directly through the top surface of the valve block.

The magnet assembly 69 also includes a magnet bar designated generally by the numeral 212 in FIGS. 5–7 and 11, the magnet bar comprising an elongated nonmetallic member preferably formed from injection molded synthetic resinous material, and having a main generally cylindrical body portion 213 from which extend diametrically opposed extension members 214 and 216. The magnet bar is also provided with a central bore 217 which forms a journal about the shaft extension 36, the magnet bar being pivotally disposed on the shaft. Mounted adjacent opposite ends of the main body extensions 214 and 216 are a pair of permanent magnets 218 and 219. These magnets are permanently mounted in the synthetic resinous magnet bar extensions so that the top surface of each of the magnets is flush with the top surface of the magnet bar extensions and the bottom surface of each of the magnets is flush with the bottom surface of the magnet bar extensions. To secure the permanent magnets in the magnet bar, the permanent magnets may be conveniently press-fitted into appropriate bores formed in the magnet bar.

Figure 5:
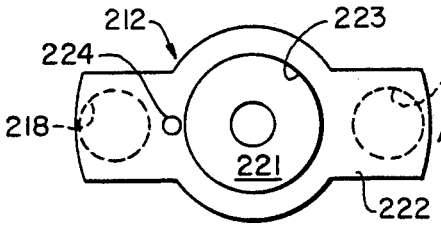
FIG. 5 is a top plan view of the reciprocable magnet assembly that controls opening and closing of the diaphragm valves.
Figure 6:
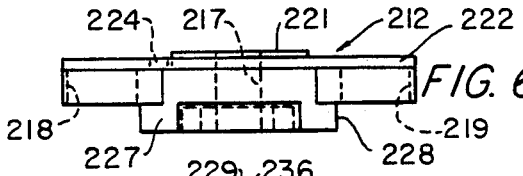
FIG. 6 is an elevational edge view of the reciprocable magnet assembly illustrated in FIG. 5.
Figure 7:
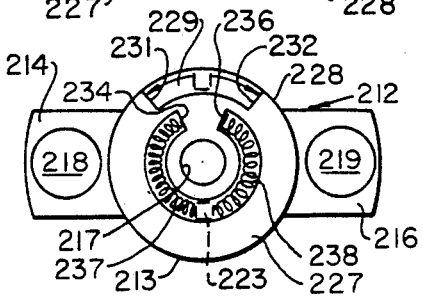
FIG. 7 is a bottom plan view of the reciprocable magnet assembly illustrated in FIG. 6.

Referring to FIGS. 5–7, it will be seen that the upper surface of the magnet bar 212 is provided with a slightly elevated boss 221 which serves as a centering device for a steel magnet keeper plate 222 adapted to overlie the top surface of the magnet bar and conform to its configuration as illustrated, so that the steel keeper plate 222 magnetically connects the two spaced permanent magnets 218 and 219 by physically contacting the top surfaces of the permanent magnets. The steel magnet keeper plate 222 is provided with a central aperture 223 that is proportioned to closely surround the boss 221, thus preventing the shaft extension 36 from coming into contact with the steel magnet keeper plate. To assure that the steel magnet keeper plate does not rotate on the magnet bar 212, the magnet bar is provided on its upper surface with an upwardly projecting boss 224 that snugly projects into a complementary aperture 226 formed in the steel magnet keeper plate along the longitudinal axis thereof but offset from the central axis of rotation of the magnet bar and keeper.

Again referring to FIGS. 5–7, it will be seen that the main body portion 213 of the magnet bar is extended downwardly in a cylindrical portion 227 in the form of a boss and is provided adjacent its outer periphery 228 with an arcuate notch 229 that follows the curvature of the outer periphery and provides abutment walls 231 and 232 circumferentially spaced from each other about seventy-five degrees measured from the center of rotation.

Also formed in the underside of the cylindrical extension 227 is a semi-circular groove 233 generally symmetrical about the central axis of rotation of the magnet bar, but not extending 360 degrees about that axis. Rather, opposite ends of the groove terminate on opposite sides of an axis line that extends transverse to the magnet bar, passes through the center of rotation thereof, and which bisects the longitudinal dimension of the groove 229 formed adjacent the outer periphery of the body extension 227. This relationship is illustrated in FIG. 7 and as there shown, the end walls 234 and 236 of the semi-circular groove 233 form abutments for the ends of coil compression springs 237 and 238. The opposite ends of the springs 237–238 remote from the abutment walls 234 and 236, oppose each other and are adapted to abut against opposite sides of the stud 208 formed on the top surface of the rotor 198, while the stud 207 on the rotor, which projects from adjacent the outer periphery 199 thereof, is adapted to slip into the arcuate notch or groove 229. With the rotor 198 thus fitted onto the underside of the magnet bar 212, with the stud 207 projecting into the notch 229 and the stud 208 projecting into the groove 233 between the associated ends of the springs 237 and 238, it will be seen that relative rotation may occur between the rotor and the magnet bar, and that the stud 207 will impinge when rotated from one extreme to the other against the abutment walls 231 and 232.

In FIG. 7, noting that this view is a bottom plan view, the studs 207 and 208 are illustrated in broken lines for clarity and are shown in a mid-position. It will be seen however that if this assembly is viewed as a top plan view as in FIG. 5, and if relative rotation of the rotor occurs so that the stud 207 moves counterclockwise toward the abutment wall 232, the stud 208 which lies on the opposite side of the center of rotation will also move counterclockwise, and tend to compress the spring 237. Since the rotor from which the stud 208 projects is fixed to the shaft 36, it will be seen that rotation of the stud 208 in the groove 233 and compression of spring 237 imposes a rotary moment on the magnet bar, tending to rotate the magnet bar counterclockwise in the same direction in which the rotor is rotated by the shaft. Conversely, if the rotor is rotated in the opposite direction, i.e., clockwise as viewed from above in FIG. 5, the stud 208 moves clockwise within the groove 233 and tends to compress the spring 238, the compressive force loaded into the spring reacting against the end wall 236 of the magnet bar and causing clockwise rotation of the magnet bar under the impetus of the tension in the spring when the magnet bar has been rotated sufficiently by the stud or lug 207 that the force of the spring exceeds the magnetic attraction between the magnets and associated armatures.

The importance of this method of operation of the magnet bar and rotor assembly and the means by which it controls actuation of the valves illustrated in FIG. 22, may perhaps be better understood by a side-by-side comparison of FIGS. 20 and 22. First, referring to FIG. 20, it will be seen that a phantom outline of the magnet bar 212 has been superimposed thereon so that the magnet 218 in the magnet bar overlies boss 167 and thereby exerts a magnetic attraction force on the armature 188 slidably contained in the cylindrical receptacle of that boss. In like manner, the permanent magnet 219 overlies the upper end of the boss 168 and magnetically attracts the armature 186 disposed within that boss so that the diaphragm valve members associated with bores 147 and 151 in FIG. 17 will be conditioned for opening of these valves so as to permit the flow of fluid thereinto. With respect to bore 147 over which the boss 167 and the permanent magnet 218 lie, this permits fluid in channel 131 to well up underneath the associated diaphragm valve and permits fluid from the lateral chambers or bays 121 and 122 to spill over into the exhaust port 97 and from there into the conduit 13.

With respect to the valve associated with the bore 151, boss 168 and permanent magnet 219, raising of the armature disposed slidably within the boss 168 permits fluid within the arcuate channel 153 associated with bore 151 to lift the diaphragm valve and permits fluid to flow into the bore 151 and thence into the transverse channel 132. However, since the diaphragm valve associated with the exhaust port 96 is still closed, it will be seen that fluid will not spill into this exhaust port 96 at this time. Now considering that fluid, which may be water, flowing into the port 151 and thence into the transverse passageway 132 will also spill into the elongated channel 99 via aperture 134 formed in the underside of the lower channel block 66 as viewed in FIG. 15, it will be seen that this fluid will flow into the piston cylinder 29 through the passageway 82 communicating with the slot or passageway 134, and cause the piston assembly to move to the left as viewed in FIG. 12. This will cause translation of the toothed rack to the left and will cause clockwise rotation of the pinion and the drive shaft portion 34 and shaft extension 36 fixed for rotation with the pinion. Such clockwise rotation of the shaft will cause clockwise rotation of the rotor, causing the spring 238 to be compressed and imposing a resilient rotary moment on the magnet bar 212.

As the rotor continues rotating and the stud or lug 207 on the rotor impinges against the wall 231, continued rotation of the rotor will obviously impose a rotary moment on the magnet bar tending to cause clockwise rotation thereof and tending to move the permanent magnet 218 from its superposed position over the end of boss 167 and the armature 188. Such rotation of the magnet bar continues until the magnetic attraction force between the permanent magnet 218 and the armature 188 is exceeded by the resilient force stored in the spring 238, at which time the magnet bar will snap into its alternate position in which the magnet 218 now lies superimposed over the boss 169, and the magnet 219 lies superimposed over the boss 170. Stated another way, the magnet bar snaps from one diagonal position to the other diagonal position, thus imposing a magnetic attraction force on the armatures 188 contained within the bosses 169 and 170, thus compressing the springs 186 contained therewithin and raising the armatures from impingement against the back sides 189 of the diaphragm valves 191, resulting in a reduction of pressure on the back sides of the valves, these valves now being fully opened by fluid pressure to permit the passage of fluid therepast.

To better understand what occurs in connection with the valve block 68 and the upper channel block portion 67 and the diaphragm valves 191 associated with the bores 148 and 149 as viewed in FIGS. 17 and 22, it should be noted that when the magnet bar 212 snaps clockwise as viewed in FIG. 20, the diaphragm valves associated with the bosses 167–168 and the bores 147 and 151 are now closed by the extension of the corresponding springs 185 contained in the bosses 167 and 168, the release of the armatures within these bosses by the movement of the permanent magnets 218 and 219 from their superposed positions over these armatures, sealing of the central aperture in each valve and admission of fluid into the recess behind these valves. These valves now close, while the diagonally opposite valves associated with the bores 148–149 in the upper channel block portion 67 are both unlatched by the influence of the magnetic circuit that imposes a magnetic attraction on the armatures 188 slidably disposed within the bosses 169–170. As these armatures are elevated, referring to FIGS. 17 and 22, fluid contained in the recesses behind the valves flows out of the central aperture, reducing the pressure behind the valve, and fluid contained in the longitudinal passageway 104 wells up through the semicircular passageway 153 surrounding the bore 149 and fluid pressure forces the diaphragm off of the seat 152 which defines the entrance to the bore 149, and fluid therefore spills into the bore 149 and consequently into the transverse passageway 109.

Since the diaphragm valve associated with the bore 147 is now closed, the armature 188 associated therewith having been released when the magnet bar switched to the right, fluid pressure builds up in passageway 109, spills into the longitudinal passageway 98 via port 133 and from there through the downwardly extending passageway 81 into the piston cylinder 28 so as to impose an axial force on the piston 51, causing the piston assembly to translate to the right as viewed in FIGS. 4 and 12, the toothed rack causing counterclockwise rotation of the pinion and attached shaft 34 and shaft extension 36, causing counterclockwise rotation of the rotor 198. Simultaneously, the piston 52 displaces fluid from cavity 29, the displaced fluid passing through passageway 99 into transverse passageway 132 and thence past the open valve associated with discharge port 96.

Simultaneously, the diaphragm valve 191 associated with bore 148 (FIG. 17), having been formerly closed, is now permitted to open and fluid to flow into the exhaust port 96 and from thence into the outlet conduit 13. Continued counterclockwise rotation of the rotor 198, through impingement of the boss 207 on the abutment wall 232 of the slot 229, imposes a counterclockwise rotary moment on the magnet bar, tending to disalign the magnet 218 from the armatures 188 associated with the bosses 169 and 170, such rotation continuing until such time that the magnetic attraction force between the magnets and their associated armatures is overcome by the resilient energy stored in the compressed spring 237, at which time, the stored energy in the spring 237 causes the magnet bar to snap quickly in a counterclockwise direction so as to realign itself in the phantom position illustrated in broken lines in FIG. 20. This pivotal reciprocation of the magnet assembly occurs approximately 288 times per minute, the reciprocation rate being dependent on the pressure of the source fluid.

Since the face of each piston has a diameter of approximately two inches (2"), it contains approximately 3.1417 square inches, and since residential water system pressures frequently are set at about forty-five (45) pounds per square inch, it will be seen that at that pressure level the reciprocating piston assembly imposes a 141 pound rotational force on the drive shaft 8, a small portion of this total force being utilized to transfer the magnet bar from one position to the other, another small portion being used to expel fluid from the opposite cavity, while the remainder of this force is passed on to the utilitarian device attached to the lower end of the drive shaft, in this case a scrub brush. It is for this reason that through normal use, we have been unable to impose sufficient frictional resistance between the brush and the surface being cleaned to stop reciprocating motion of the scrub brush.

In the interest of safety, in order to prevent the rapidly reciprocating magnetic assembly from doing injury to the operator, and to provide a means of holding the device while in use, there is provided a cover member designated generally by the numeral 241 and comprising a hollow shell having a top wall 242 provided with appropriate bores 243 to receive mounting screws (not shown) for detachable attachment of the cover member to the top surface of the valve block 68. The cover is provided with a flange 244 projecting laterally from one side of the cover member, and within the cover member is a recess 246 having diametrically opposed abutment members 247 through which the mounting holes 243 extend as illustrated. The laterally extending hand-hold 244 is provided with a downwardly projecting flange 248 which cooperates with the associated flat surface 249 of the cover member to form a channel into which the fingers may be inserted in order to gain a hand-hold on the cover. The diametrically opposed abutments 247 function also to limit pivotal rotation of the magnet bar 212 since that component is rotatably mounted on the shaft extension 36 and is not otherwise inhibited from rotation. The extent of pivotal rotation of the magnet bar 212 within the cover member recess 246 as limited by the abutments 247 is closely correlated to the extent of pivotal excursion imposed on the magnet bar by the boss 207 on the rotor 198. Obviously, the rotary inertia of the magnet bar 212 continues its pivotal rotation for a slight amount beyond where the boss 207 stops its pivotal movement and reverses its direction of movement under the impetus of the reversed direction of movement of the piston assembly within the motor block. Such continued pivotal rotation continues until the ends of the magnet bar abut the abutments 247 within the cover.

Having thus described the invention, what is believed to be new and novel, and sought to be protected by letters patent of the United States is as follows in the appended claims.

We claim:

1. A fluid drive motor for producing rotary reciprocating motion, comprising:

a) a motor body arranged about a longitudinal axis and having fluid ingress and egress passageways including fluid distribution ports communicating with a pair of opposed piston cavities formed within the motor body and closed at their adjacent ends by a transverse wall and closed at their remote ends by seal walls detachably secured to the motor body;

b) a piston assembly mounted within the motor body and including a double-acting pair of pistons slidably disposed sealingly in said pair of opposed piston cavities, and a toothed rack interconnecting said pistons on opposite sides of said transverse wall;

c) a drive assembly mounted on said motor body and including an elongated drive shaft extending through said body transverse to the longitudinal axis thereof and having a pinion gear fixed thereon operatively engaged with said toothed rack whereby axial reciprocation of said piston assembly including said toothed rack effects rotary reciprocation of said drive assembly including said elongated drive shaft;

d) fluid distribution means mounted on said motor body for directing fluid alternatively to and from each of said piston cavities to effect axial reciprocation of said pistons within said piston cavities and including a fluid channel block having ports communicating with said fluid distribution ports in the motor body and a valve block operatively associated with said channel block and having valve means operable to control the flow of fluid through said channel block; and e) a non-electrical control mechanism operatively associated with said valve block and said drive shaft and operable in cooperation with said valve means to control the flow of fluid under pressure through said motor body to effect axial reciprocation of said piston assembly and rotary reciprocation of said drive assembly;

f) said valve means including two pairs of diaphragm valves, one valve of each pair being open for the passage of fluid therepast while the remaining valve of each pair is closed to prevent passage of fluid therepast, one of said open valves admitting fluid under pressure to one of said piston cavities to effect displacement of the piston therein while the other open valve enables fluid to be discharged from the other of said piston cavities by displacement of the piston therein.

2. A fluid drive motor for producing rotary reciprocating motion, comprising:

a) a motor body arranged about a longitudinal axis and having fluid ingress and egress passageways including fluid distribution ports communicating with a pair of opposed piston cavities formed within the motor body and closed at their adjacent ends by a transverse wall and closed at their remote ends by seal walls detachable secured to the motor body;

b) a piston assembly mounted within the motor body and including a double-acting pair of pistons slidably disposed sealingly in said pair of opposed piston cavities, and a toothed rack interconnecting said pistons on opposite sides of said transverse wall;

c) a drive assembly mounted on said motor body and including an elongated drive shaft extending through said body transverse to the longitudinal axis thereof and having a pinion gear fixed thereon operatively engaged with said toothed rack whereby axial reciprocation of said piston assembly including said toothed rack effects rotary reciprocation of said drive assembly including said elongated drive shaft;

d) fluid distribution means mounted on said motor body for directing fluid alternatively to and from each of said piston cavities to effect axial reciprocation of said pistons within said piston cavities and including a fluid channel block having ports communicating with said fluid distribution ports in the motor body and a valve block operatively associated with said channel block and having valve means operable to control the flow of fluid through said channel block; and e) a control mechanism operatively associated with said valve block and said drive shaft and operable in cooperation with said valve means to control the flow of fluid under pressure through said motor body to effect axial reciprocation of said piston assembly and rotary reciprocation of said drive assembly;

f) said valve means including two pairs of diaphragm valves operable to control the flow of fluid through said fluid channel block, each said diaphragm valve of each pair thereof including a flexible diaphragm having a sealing surface thereon and a plurality of apertures therethrough and an associated annular valve seat against which the sealing surface of said diaphragm may sealingly abut to prevent the passage of fluid therepast or from which said diaphragm may be separated to permit the passage of fluid therepast, at least one of said plurality of apertures in said flexible diaphragm arranged to admit fluid under pressure through said diaphragm whereby said fluid under pressure exerts a sealing force on said diaphragm and another of said plurality of apertures in said flexible diaphragm is adapted to be closed when said diaphragm valve is closed and opened to relieve the pressure of said fluid behind said flexible diaphragm when said diaphragm valve is to be opened, magnetically responsive armature means normally biasing each said flexible diaphragm in a closing direction and closing said another of said plurality of apertures in said flexible diaphragm, and said control assembly includes a rotatably reciprocably bar having a pair of magnets thereon adapted to be positioned alternately in magnetic association with two of said armature means whereby said armatures are displaced to open the apertures closed thereby and relieve the closing pressure on said diaphragms whereby to allow opening of said diaphragm valves and permit the passage of fluid therepast.

3. The combination according to claim 2, in which said control mechanism includes a rotor mounted on said drive shaft for rotation therewith and having first and second bosses thereon, said reciprocable bar includes a central body portion having an outer periphery and a central aperture by which said bar is rotatably mounted on said drive shaft adjacent said rotor, said central body portion having a pair of semi-circular grooves formed therein, a first one of said grooves being adjacent the outer periphery of said central body portion and the second groove being adjacent the central aperture, whereby said first boss on said rotor projects into said groove adjacent the outer periphery and is adapted to abut the ends of said groove to pivot said bar when said drive shaft is pivoted, and said second boss projects into said semi-circular groove adjacent said central aperture, a pair of coil compression springs mounted in said semi-circular groove adjacent said central aperture and having adjacent ends abutting said second boss and remote ends abutting associated ends of said semi-circular groove, whereby rotation of said drive shaft in one direction effects corresponding rotation of said rotor and bosses to rotate the bar and compress one of said coil compression springs to shift the bar and magnets thereon from a first position overlying two of said armatures to a second position overlying the two remaining armatures to thereby effect closing of the diaphragm valves associated with said first position and effect opening of the diaphragm valves associated with said second position.

4. A fluid drive motor for producing rotary reciprocating motion, comprising:

a) a motor body arranged about a longitudinal axis and having fluid ingress and egress passageways including fluid distribution ports communicating with a pair of opposed piston cavities formed within the motor body and closed at their adjacent ends by a transverse wall and closed at their remote ends by seal walls detachably secured to the motor body;

b) a piston assembly mounted within the motor body and including a double-acting pair of pistons slidably disposed sealingly in said pair of opposed piston cavities, and a toothed rack interconnecting said pistons on opposite sides of said transverse wall;

c) a drive assembly mounted on said motor body and including an elongated drive shaft extending through said body transverse to the longitudinal axis thereof and having a pinion gear fixed thereon operatively engaged with said toothed rack whereby axial reciprocation of said piston assembly including said toothed rack effects rotary reciprocation of said drive assembly including said elongated drive shaft;

d) fluid distribution means mounted on said motor body for directing fluid alternatively to and from each of said piston cavities to effect axial reciprocation of said pistons within said piston cavities and including a fluid channel block having ports communicating with said fluid distribution ports in the motor body and a valve block operatively associated with said channel block and having valve means operable to control the flow of fluid through said channel block;

e) a control mechanism operatively associated with said valve block and said drive shaft and operable in cooperation with said valve means to control the flow of fluid under pressure through said motor body to effect axial reciprocation of said piston assembly and rotary reciprocation of said drive assembly;

f) a single operating fluid ingress passageway and a single operating fluid egress passageway provided in said motor body, a single operating fluid distribution port in said motor body communicating with said ingress passageway, an operating fluid reservoir in said channel block communicating with said single operating fluid distribution port and adapted to receive fluid under pressure from said distribution port, a pair of fluid discharge ports in said channel block communicating with said single operating fluid egress passageway in said motor body, fluid distribution means in said channel block adapted to alternately distribute fluid under pressure from said reservoir first to one of said piston cavities and then to the other piston cavity and simultaneously discharge fluid from said other piston cavity to said egress passageway in said motor block, said valve means and said control assembly being responsive to reciprocating rotation of said drive shaft to control distribution of fluid from said reservoir to said piston cavities and discharge of fluid from said piston cavities to said egress passageway; and g) said control mechanism including a rotor mounted on said drive shaft for rotation therewith and having first and second bosses thereon, a bar pivotally mounted on said drive shaft adjacent said rotor and having a pair of semi-circular grooves formed therein, a pair of coil compression springs mounted in one of said semi-circular grooves, said first boss on said rotor projecting into one of said semi-circular grooves while said second boss projects into the other semi-circular groove in which said springs are mounted and between adjacent ends of said springs, the remote ends of said springs abutting the end walls of said semi-circular groove, and a magnet mounted adjacent each opposite end of said bar and adapted to be positioned in magnetically active relationship with selected valve means upon reciprocation of said drive shaft.

5. A fluid drive motor for producing rotary reciprocating motion, comprising:

a) a motor body arranged about a longitudinal axis and having fluid ingress and egress passageways including fluid distribution ports communicating with a pair of opposed piston cavities formed within the motor body and closed at their adjacent ends by a transverse wall and closed at their remote ends by seal walls detachably secured to the motor body;

b) a piston assembly mounted within the motor body and including a double-acting pair of pistons slidably disposed sealingly in said pair of opposed piston cavities and a toothed rack interconnecting said pistons on opposite sides of said transverse wall;

c) a drive assembly mounted on said motor body and including an elongated drive shaft extending through said body transverse to the longitudinal axis thereof and having a pinion gear fixed thereon operatively engaged with said toothed rack whereby axial reciprocation of said piston assembly including said toothed rack effects rotary reciprocation of said drive assembly including said elongated drive shaft;

d) fluid distribution means mounted on said motor body for directing fluid alternatively to and from each of said piston cavities to effect axial reciprocation of said pistons within said piston cavities and including a fluid channel block having ports communicating with said fluid distribution ports in the motor body and a valve block operatively associated with said channel block and having valve means operable to control the flow of fluid through said channel block;

e) a control mechanism operatively associated with said valve block and said drive shaft and operable in cooperation with said valve means to control the flow of fluid under pressure through said motor body to effect axial reciprocation of said drive assembly; and f) means in said fluid distribution means for preventing hydraulic lock-up of said piston assembly;

g) said means for preventing hydraulic lock-up of said piston assembly comprising a pair of small anti-lockup bores constituting fluid escape passageways formed in said fluid channel block.

* * * * *